United States Patent [19]

Thoren

[11] Patent Number: 4,558,296

[45] Date of Patent: Dec. 10, 1985

[54] SOUND DAMPING DEVICES

[75] Inventor: Stellan Thoren, Västerås, Sweden

[73] Assignee: ASEA Aktiebolag, Västerås, Sweden

[21] Appl. No.: 698,478

[22] Filed: Feb. 5, 1985

[30] Foreign Application Priority Data

Feb. 14, 1984 [SE] Sweden ..... 8400776

[51] Int. Cl.[4] ..... H01F 15/00

[52] U.S. Cl. ..... 336/100; 181/202; 181/208

[58] Field of Search ..... 336/98, 100; 181/202, 181/208

[56] References Cited

U.S. PATENT DOCUMENTS

| | | | |
|---|---|---|---|
| 1,846,887 | 2/1932 | Matthews | 336/100 |
| 3,260,974 | 7/1966 | Specht et al. | 181/202 X |
| 3,305,813 | 2/1967 | Toothman et al. | 336/100 |
| 4,347,043 | 8/1982 | Morris | 181/202 X |

*Primary Examiner*—Benjamin R. Fuller

*Attorney, Agent, or Firm*—Pollock, Vande Sande & Priddy

[57] ABSTRACT

A hollow sound damping plate is arranged between a transformer core and an internal limiting surface of a transformer tank filled with insulating fluid. At least one compressive-force transmitting spring member (8) is arranged between the front wall (6) and the rear wall (5).

11 Claims, 5 Drawing Figures

SOUND DAMPING DEVICES

TECHNICAL FIELD

The present invention relates to a sound damping device for an inductive a.c. apparatus with an iron core, an enclosure tank as well as an insulating fluid present in the enclosure tank. The device comprises at least one hollow sound damping plate arranged in said enclosure tank. The sound damping plate has a front wall with an outside and an inside, the outside facing said iron core, and a rear wall. The walls are connected to each other along the circumference of said damping plate in such a way that a pressure-tight cavity is defined by said walls. The cavity contains a gas which, at room temperature and a normal level of said insulating fluid, has a pressure of at most 600 mbar. A gap between the front wall and the rear wall contains at least one force-transmitting member made of solid material and arranged to transmit compressive forces from the front wall to the rear wall. The internal surface of said front wall has at least one contact surface portion arranged in contact with at least one of the force-transmitting members.

DISCUSSION OF PRIOR ART

A device according to the above is known from U.S. Pat. No. 1,846,887. In the known device all of the above-mentioned force-transmitting members are rigid distance blocks. The sound damping plate is intended to absorb the vibrations generate by the inductive apparatus, so that these vibrations do not manifest themselves in a liquid layer located between the sound damping plate and an inner wall surface of the enclosure tank. Sound damping plates based on the principle of absorption have not turned out to be sufficiently efficient when used in transformers.

DISCLOSURE OF THE INVENTION

The task which the invention airs to solve is to improve the known sound damping plate in such a way that a considerably greater sound damping effect is attained. For the purpose of achieving this, the sound damping plate according to the invention is designed to function according to a principle which differs greatly from the principle on which the known device is based. While the known sound damping plate is designed in view of absorption of the vibrations supplied through the insulating fluid, the purpose of a sound damping plate according to the invention is to reflect such vibrations to as great an extent as possible, so that their energy can be transformed into heat energy developed in the insulating fluid in the space between the damping device and the transformer core.

Theoretically, it is conceivable to realize the principle of reflection with a damping plate in which all of the above-mentioned force-transmitting members—similarly to those described in specification no. 1,846,887—are stiff bodies. However, this would presuppose that the thickness of the front wall is chosen very small while at the same time the distances between the distance blocks are chosen sufficiently large to render great flexibility to the front wall. Such a design, however, can only be used if the difference between the external and the internal static pressure of the sound damping plate is relatively small, and therefore such a design would hardly be useful in a transformer of the initially stated kind. In such transformers the insulating fluid results in a considerable fluid pressure on the outside of the sound damping plate. Since, in addition, it is desirable to a greater or smaller degree to evacuate the hollow sound damping plate for the purpose of having as small a gas supply as possible to the insulating fluid in the event of a leakage, a sound damping plate will normally be subjected to a great static pressure difference. If—under such circumstances—a sound damping plate were made with a very thin front wall and substantially stiff force-transmitting members between the front wall and the rear wall, the diaphragm-like portions of the front wall would be pressed inwardly and deformed to such a degree that they would no longer respond to vibrations with the flexibility required for giving the reflection mentioned above.

With a sound damping device according to the invention, all the pressure forces, or most of the pressure forces transmitted from the front wall to the rear wall, are transmitted by means of one or several elastically resilient force-transmitting members.

With a device according to the invention, at least part of the total area of the contact surfaces belonging to the front wall and making contact with the force-transmitting members (or member) is constituted by front wall contact surfaces making contact with contact surfaces belonging to elastically resilient force-transmitting members. When all elastically resilient force-transmitting members are disposed in the initially mentioned cavity, the above-mentioned part of the total contact surface area is always greater than 50%, preferably greater than 70%, of the total contact surface located in the cavity.

According to a second embodiment of the invention, the side wall defining the above-mentioned cavity is elastically resilient.

BRIEF DESCRIPTION OF DRAWINGS

Two embodiments of the invention will be described in the following with reference to the accompanying schematic drawings, wherein.

DESCRIPTION OF PREFERRED EMBODIMENTS

Figure 1:
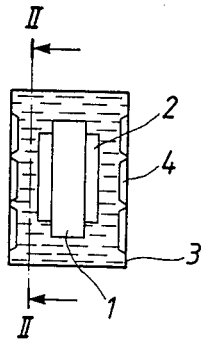
FIG. 1 shows a vertical section through a transformer which is provided with a sound damping device according to the invention.
Figure 2:
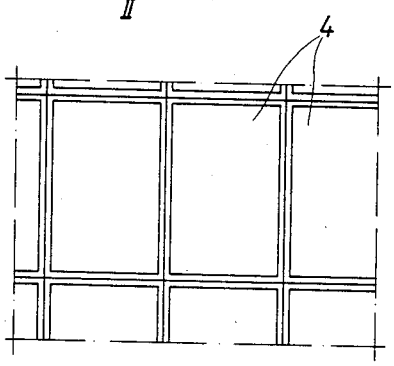
FIG. 2 shows a partial view of the transformer shown in FIG. 1, perpendicular to a vertical plane through the line II and perpendicular to a plane wall portion of the transformer tank of the transformer.
Figure 3:
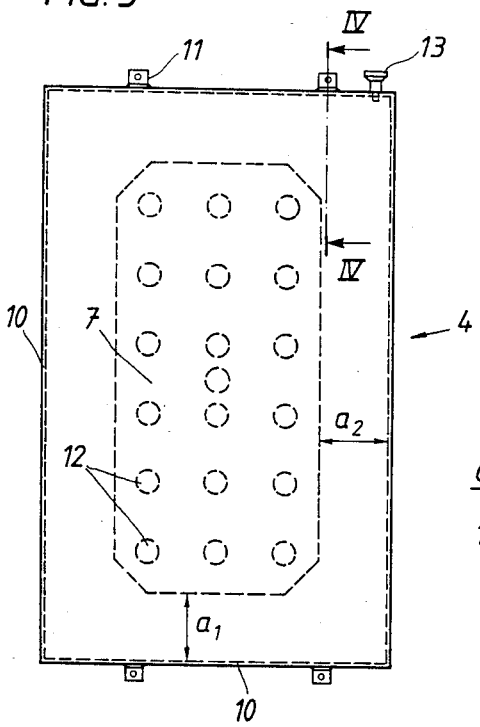
FIG. 3 shows an enlarged detail of FIG. 2, according to a first embodiment of the invention.
Figure 4:
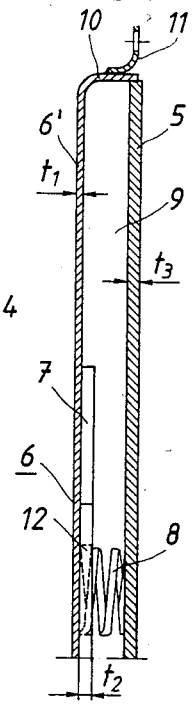
FIG. 4 shows an enlarged partial section along IV—IV of FIG. 3.

In the drawings 1 designates a transformer core which together with the associated windings 2 is enclosed in a transformer tank 3 filled with an insulating fluid, for example transformer oil. A plurality of sound damping plates 4 are attached, by means of welded-on lugs 11, to the inside of the vertical walls of the transformer tank. Each damping plate 4 has a metallic front wall 6, facing the transformer core, and a rectangular, metallic rear wall 5 attached to the inside of the transformer tank. A rigid side wall 10, gas-tightly connected with the front wall 6, runs along the entire circumference of the front wall and is gas-tightly welded to the rear wall 5 along the entire circumference thereof. The front wall 6 comprises a relatively thin-walled sheet portion 6' and a metallic plate 7 welded or glued to the inside of said sheet portion. The plate 7 is usually provided with at least four—in the shown case with nineteen—through-holes 12. Each of these holes 12 accomodates an end portion of a corresponding helical metallic pressure spring 8, which is arranged between the front wall and the rear wall in a compressive-force transmitting connection with each of them. The springs 8 are dimensioned in such a way that each spring has a natural frequency which is at least twice, preferably at least five times the rated frequency of the above-mentioned a.c. apparatus located in the enclosure tank 3. The front wall 6 has a frame-shaped edge portion extending along the circumference of the entire front wall, the width of said edge portion at the ends of the plate 7 being designated $a_1$, whereas the width of the edge portion in the transverse direction of the plate 7 is designated $a_2$. According to a first alternative, it is possible to use instead of the plate 7 a plurality of sheet elements or bars fixed to the sheet portion 6', said sheet elements or bars being substantially disposed in the same area as the plate 7. According to a second alternative, a relatively thin edge portion can be achieved by means of plastic or chip-separating machining. In all cases the front wall 6 has an edge portion extending along the whole of or the greater part of the circumference of the front wall, the average wall thickness of said edge portion being considerably smaller than the average total wall thickness of the rest of the front wall, for example smaller than 80%, preferably smaller than 60% thereof, whereas the average width of the above-mentioned edge portion is at least ten times, preferably at least twenty times its average thickness. The thickness of the thin-walled sheet portion 6' is $t_1$, whereas the thickness of the plate 7 is $t_2$. The rear wall 5 preferably has a constant thickness, $t_3$. Its average thickness is preferably at least 100% greater than the wall thickness $t_1$ of the abovementioned edge portion.

The side wall 10 is rigid and has an average thickness which preferably constitutes less than 150% of the average wall thickness of the above-mentioned edge portion. The side wall 10 and/or the edge portion may advantageously contain corrugated portions.

The cavity or chamber 9 defined by the front wall 6, the rear wall 5 and the side walls 10 is more or less evacuated by means of an evacuating valve 13 welded to the sound damping plate 4. After completed evacuation, said valve 13 has been sealed by welding. At room temperature and without an externally acting fluid pressure, the pressure in the sound damping plate 4 is less than 600 mbar, preferably less than 300 mbar. When the transformer tank 3 is filled with insulating fluid, the pressure in the sound damping plate, owing to a corresponding compression thereof, may assume a valve which is somewhat higher, usually at most 50% higher, than the internal pressure at atmospheric pressure, only, on the external surfaces of the sound damping plate. Usually the pressure in the sound damping plate 4 at room temperature and in case of fluid-filled transformer tank is less than 700 mbar, preferably less than 400 mbar, for example 100 mbar.

Figure 5:
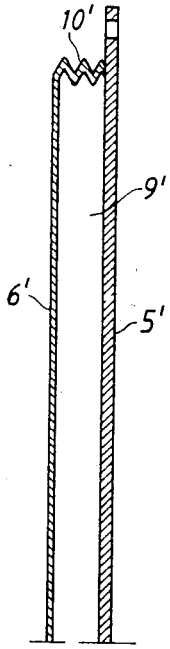
FIG. 5 shows a detail corresponding to that of FIG. 4, according to a second embodiment of the invention.

With the embodiment shown in FIG. 5, the front wall 6' and the rear wall 5' together with a side wall 10' define a chamber 9' which is gas-filled in the same way as the chamber 9 described above. The side wall 10 runs along the whole circumference of the walls 5' and 6', and it constitutes a bellows-like elastic resilient body. The natural frequency of this body is at least twice the rated frequency of the transformer 1. The bellows-like body 10' constitutes the only elastically resilient member of the sound damping device. Alternatively, additional elastic members may be arranged in the chamber 9'.

In addition to the sound damping device described with reference to the drawing, the invention comprises a plurality of deviating embodiments.

Thus, a sound damping plate according to the invention may in certain cases possibly include, in addition to resilient elements, a smaller number of stiff distance blocks, for example if the plate 7 is replaced by two plates which are welded to plate 6' in the same way as the plate 7 and mutually spaced-apart, stiff distance blocks then being arranged in the intermediate gap. In all cases, however, the intermediate gap between the front wall and the rear wall contains at least one force-transmitting member made of solid material and arranged to transmit compressive forces between these walls, whereby at least part of the contact surface area between the force-transmitting members (or member) and the front wall belongs to at least one elastic resilient force-transmitting member.

Instead of helical springs, it is possible to use spring members of a different structure, for example cup springs or elastically resilient yokes. Further, instead of the shown springs it is possible to use a plurality of elastically resilient bodies of rubber or the like, or it is possible to use one single such body which fills up a major part, for example 95%, of the cavity. However, rubber and materials with similar properties should preferably be avoided since they have a progressive resilient characteristic and a great loss factor. These properties tend to provide relatively great dynamic rigidity, which is unfavourable. In addition, the rubber materials or rubber-like materials which can be used from the point of view of price have the disadvantage of becoming dissolved in the insulating fluid in the event of a leakage on a damping plate, thus reducing the insulating capacity of the insulating fluid.

Instead of making the sound damping tank with metallic walls only, walls of a glass-fiber lamination, or the like, can be used completely or partially.

The invention also comprises the case where a wall portion of the enclosure tank is welded to the side wall of the sound damping plate and included in the rear wall of the sound damping plate. Further, in certain cases it is possible—instead of making the front wall with a relatively thin edge portion—to use a front wall with a constant wall thickness.

I claim:

1. A sound damping device for an inductive a.c. apparatus with an iron core (1), an enclosure tank (3) and an insulating fluid located in the enclosure tank, comprising at least one hollow sound damping plate (4) arranged in said enclosure tank, said sound damping plate having a front wall (6,6') with an outside and an inside, said outside facing said iron core (1), and a rear wall (5,5'), said walls being connected to each other along the circumference of said damping plate in such a way that a pressure-tight cavity (9,9') is defined by means of said walls, said cavity (9,9') containing a gas which, at room temperature and in case of a normal level of said insulating fluid, has a pressure of at most 600 mbar, the intermediate gap between said walls containing at least one force-transmitting member made of solid material and arranged to transmit compressive forces from said front wall to said rear wall, the internal surface of said front wall having at least one contact surface portion arranged in contact with said at least one force-transmitting member, wherein at least part of the corresponding contact surface area of said at least one force-transmitting member belongs to at least one elastically resilient force-transmitting member (8,10').

2. Sound damping device as claimed in claim 1, wherein all of said elastically resilient force-transmitting members (8) are arranged in said cavity (9).

3. Sound damping device as claimed in claim 2, wherein more than 50% of said corresponding contact surface area—within said cavity—belongs to at least one elastically resilient force-transmitting member (8).

4. Sound damping device as claimed in claim 1, wherein said at least one elastically resilient member has a natural frequency which is at least twice the rated frequency of said a.c. apparatus.

5. Sound damping device as claimed in claim 1, wherein said front wall (6) has an edge portion extending along the entire circumference or a greater part of the circumference of the front wall, the average wall thickness of said edge portion being at most 60% of the average wall thickness of the remaining part of the front wall.

6. Sound damping device as claimed in claim 5, wherein said annular edge portion is at least partially made of corrugated steel sheet.

7. Sound damping device as claimed in claim 5, wherein the average width (a) of said edge portion is at least ten times the average wall thickness ($t_1$) of said edge portion.

8. Sound damping device as claimed in claim 7, wherein said front wall (6) comprises a sheet portion (6'), the area of which is approximately equal to the area of said front wall, as well as at least one stiff body (7), fixed to said sheet portion (6'), the major part of said at least one stiff body being include in a front wall portion surrounded by said edge portion.

9. Sound damping device as claimed in claim 7, wherein the average thickness ($t_3$) of said rear wall (5) is at least 100% greater than the wall thickness ($t_1$) of said edge portion.

10. Sound damping device as claimed in claim 1, wherein said cavity (9') has a side wall (10') connected between said front wall (6') and said rear wall (5'), said side wall running along the entire circumference of said front wall and said rear wall, and comprising a bellows-like, elastically resilient body.

11. Sound damping device as claimed in claim 10, wherein said bellows-like body (10') has a natural frequency which is at least twice the rated frequency of said a.c. apparatus.

* * * * *